US009151557B2

(12) United States Patent
Daley, Jr.

(10) Patent No.: US 9,151,557 B2
(45) Date of Patent: Oct. 6, 2015

(54) AUTOMATIC SEAR ASSEMBLY FOR A RIFLE

(71) Applicant: SIG SAUER, Inc., Newington, NH (US)

(72) Inventor: William C. Daley, Jr., Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/276,045

(22) Filed: May 13, 2014

(65) Prior Publication Data

US 2014/0338523 A1 Nov. 20, 2014

Related U.S. Application Data

(60) Provisional application No. 61/824,393, filed on May 17, 2013.

(51) Int. Cl.
*F41A 19/31* (2006.01)
*F41A 19/46* (2006.01)
*F41A 19/12* (2006.01)

(52) U.S. Cl.
CPC ..... *F41A 19/46* (2013.01); *F41A 19/12* (2013.01)

(58) Field of Classification Search
CPC ..... F41A 19/46; F41A 19/31; F41A 19/33; F41A 19/44
USPC ..... 89/132–154
See application file for complete search history.

(56) References Cited

U.S. PATENT DOCUMENTS

| | | | | |
|---|---|---|---|---|
| 3,045,555 | A * | 7/1962 | Stoner | 89/142 |
| 3,292,492 | A * | 12/1966 | Sturtevant | 89/128 |
| 3,318,192 | A * | 5/1967 | Sullivan et al. | 89/142 |
| 3,442,173 | A * | 5/1969 | Muller | 89/127 |
| 5,251,533 | A * | 10/1993 | Layton | 89/142 |
| 5,713,150 | A * | 2/1998 | Ealovega | 42/84 |
| 6,615,527 | B1 * | 9/2003 | Martin | 42/69.03 |
| 7,654,187 | B2 * | 2/2010 | Hochstrate et al. | 89/142 |
| 2005/0241470 | A1 * | 11/2005 | Hochstrate et al. | 89/142 |
| 2010/0132541 | A1 * | 6/2010 | Hochstrate et al. | 89/142 |

* cited by examiner

*Primary Examiner* — Samir Abdosh
(74) *Attorney, Agent, or Firm* — Finch & Maloney PLLC

(57) ABSTRACT

An automatic sear assembly for providing a large-bore rifle with full-automatic firing and/or burst firing capabilities is disclosed. In accordance with some embodiments, the disclosed assembly includes an automatic sear operatively configured with a sear lever which is provided with bidirectional articulation for selectively imparting torque on the automatic sear to cause tripping thereof. For example, the disclosed assembly can be configured such that rotational deflection of the sear lever away from the automatic sear imparts no rotation thereto, whereas rotational deflection of the sear lever toward the automatic sear imparts rotation thereto. Thus, and in accordance with some embodiments, the disclosed sear assembly can be used in a rifle, for example, to utilize the force of a moving bolt carrier during a given firing cycle to initiate a subsequent firing cycle without need to release and once again operate the trigger of the rifle.

20 Claims, 11 Drawing Sheets

Figure 3A
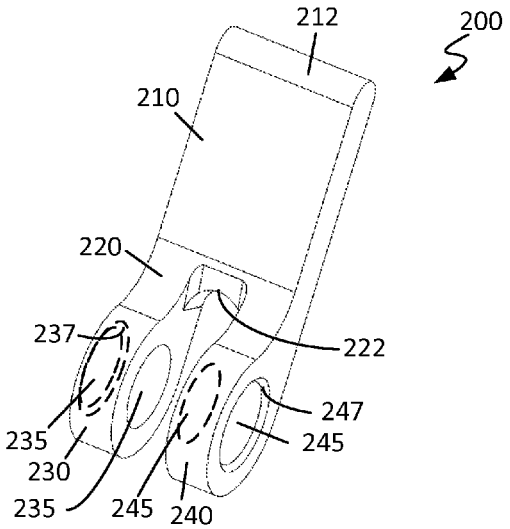
Figure 3C
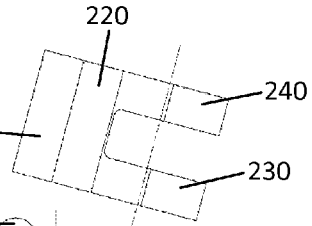
Figure 3D
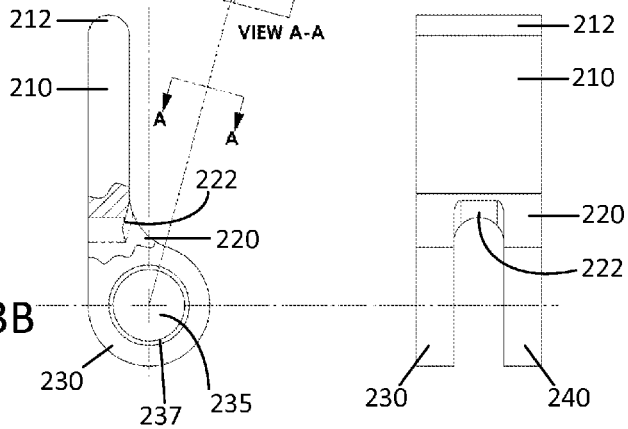
Figure 3B

Figure 4A
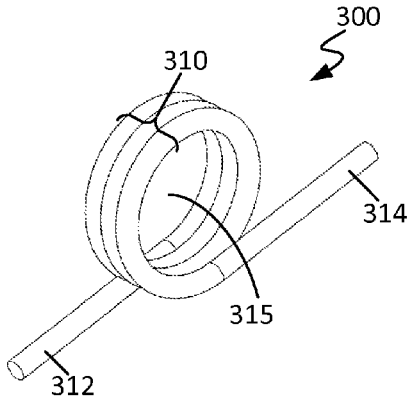
Figure 4B
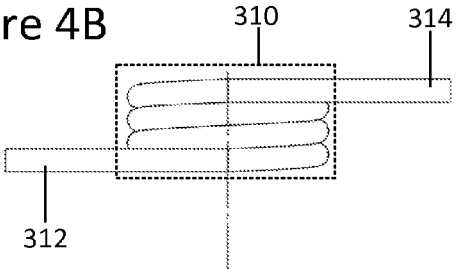
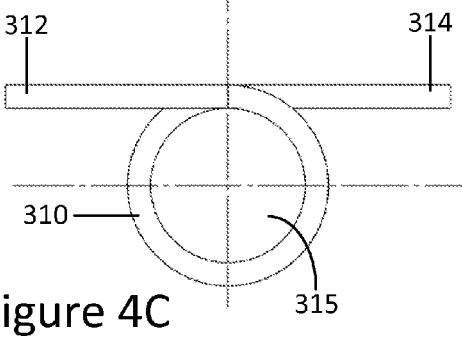
Figure 4C
Figure 4D
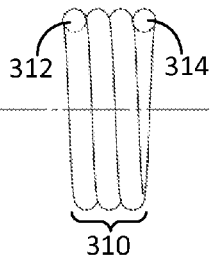

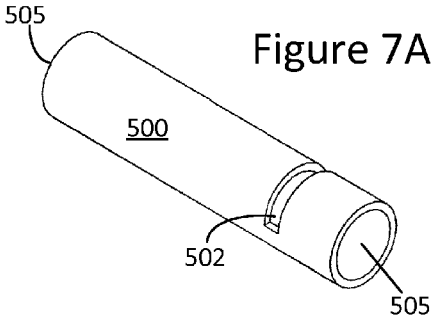
Figure 7A
Figure 7B
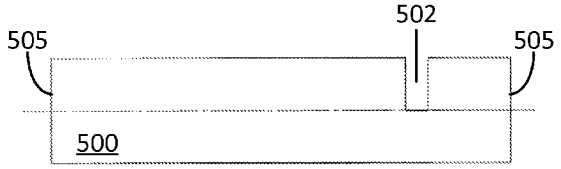
Figure 7C
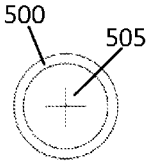
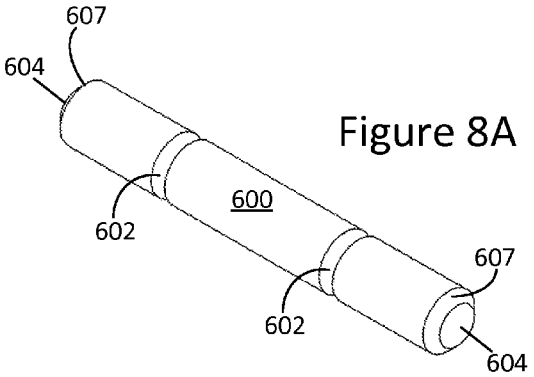
Figure 8A
Figure 8B
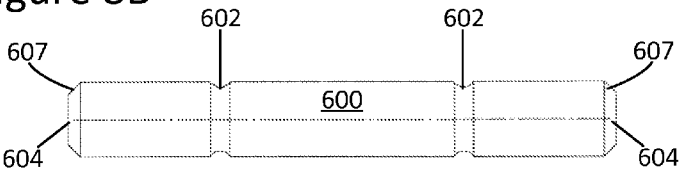
Figure 8C
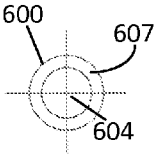

AUTOMATIC SEAR ASSEMBLY FOR A RIFLE

CROSS-REFERENCE TO RELATED APPLICATIONS

This application claims the benefit of U.S. Provisional Patent Application No. 61/824,393, filed on May 17, 2013, which is herein incorporated by reference in its entirety.

FIELD OF THE DISCLOSURE

The disclosure relates to firearms and more particularly to large-bore rifles.

BACKGROUND

Firearm design involves a number of non-trivial challenges, and large-bore rifles have faced particular complications, such as those with respect to achieving selective-fire capabilities.

SUMMARY

One example embodiment provides an automatic sear assembly for a rifle, the assembly comprising: an automatic sear configured to be operatively coupled with a safe/fire selector switch and a hammer of the rifle; a sear lever disposed adjacent a rear surface of the automatic sear and extending beyond a height of the automatic sear; a first spring disposed adjacent the sear lever and the rear surface of the automatic sear and configured to bias the sear lever into physical contact with the rear surface of the automatic sear; and a second spring disposed adjacent the sear lever and the rear surface of the automatic sear and configured to operatively interface with the safe/fire selector switch; wherein the automatic sear, the sear lever, the first spring, and the second spring share a rotational axis; and wherein rotational deflection of the sear lever in a first direction about the shared rotational axis causes the sear lever to rotate out of physical contact with the rear surface of the automatic sear, and rotational deflection of the sear lever in a second direction about the shared rotational axis imparts rotation to the automatic sear causing the automatic sear to sear with the hammer of the rifle. In some cases, the sear lever is configured to be incident with a bolt carrier of the rifle, the bolt carrier providing rotational deflection of the sear lever in at least one of the first direction and/or the second direction about the shared rotational axis. In some instances, the sear lever extends beyond the height of the automatic sear by a distance in the range of about ⅛ to ½ inch. In some cases, the first spring comprises a helical torsion spring including a set of coils ending in first and second tangential legs. In some cases, toggling of the safe/fire selector switch into a full-automatic firing mode or a burst-firing mode causes the automatic sear to rotate about the shared rotational axis into index with the hammer of the rifle, and toggling of the safe/fire selector switch into a semi-automatic firing mode or a safe mode causes the automatic sear to rotate about the shared rotational axis out of index with the hammer of the rifle. In some instances, the assembly further comprises a bushing inserted along the shared rotational axis. In some such instances, the assembly further comprises a pin inserted within the bushing along the shared rotational axis. In some cases, the second spring comprises a helical double-torsion spring including first and second sets of coils wound in opposing directions and having an unwound portion disposed there between, the first set of coils ending in a tangential leg configured to operatively interface with the safe/fire selector switch of the rifle, and the second set of coils ending in a radial over-center leg. In some such cases, the assembly further comprises: a bushing inserted along the shared rotational axis, the bushing having a slot formed therein; and a pin inserted within the bushing along the shared rotational axis, the pin having a groove formed therein; wherein the groove and the slot are configured to align when the pin is inserted within the bushing and configured to receive the radial over-center leg of the second spring. In some cases, at least a portion of the assembly is compliant with United States Defense Standard MIL-W-13855 (Weapons: Small Arms and Aircraft Armament Subsystems, General Specification For). In some instances, a rifle comprising the automatic sear assembly is provided. In some such cases, the rifle is chambered for rounds larger than or equal to .223 caliber rounds (5.56×45 mm NATO rounds). In some instances, the rifle is chambered for .308 caliber rounds (7.62×51 mm NATO rounds). In some other instances, the rifle is chambered for .30-06 caliber rounds (7.62×63 mm rounds). In some cases, the rifle is constructed and arranged to implement at least one of a full-automatic firing mode, a burst-firing mode, a semi-automatic firing mode, and/or a safe mode.

Another example embodiment provides an automatic sear assembly for a rifle, the assembly comprising: an automatic sear rotationally mounted about an axis, the automatic sear having an actuating portion which extends a first radial length from the axis in a first direction and a second radial length from the axis in a second direction which substantially opposes the first direction, wherein the automatic sear interfaces with a safe/fire selector switch and a hammer of the rifle; a sear lever rotationally mounted about the axis independently of the automatic sear, the sear lever extending a third radial length from the axis in substantially the same first direction, wherein the third radial length is greater than the first radial length; a first spring mounted about the axis and biasing the sear lever into physical contact with the automatic sear; and a second spring mounted about the axis and angularly biasing the automatic sear about the axis, wherein the second spring interfaces with the safe/fire selector switch. In some cases, the third radial length is greater than the first radial length by a distance in the range of about ⅛ to ½ inch. In some instances, toggling of the safe/fire selector switch into a full-automatic firing mode or a burst-firing mode causes the automatic sear to rotate about the shared rotational axis into index with the hammer of the rifle; and toggling of the safe/fire selector switch into a semi-automatic firing mode or a safe mode causes the automatic sear to rotate about the shared rotational axis out of index with the hammer of the rifle.

Yet another example embodiment provides an automatic sear assembly for a rifle, the assembly comprising: an automatic sear configured to be operatively coupled with a safe/fire selector switch and a hammer of the rifle; a sear lever disposed adjacent a rear surface of the automatic sear and extending beyond a height of the automatic sear; a helical torsion spring disposed adjacent the sear lever and the rear surface of the automatic sear and comprising a set of coils ending in first and second tangential legs configured to bias the sear lever into physical contact with the rear surface of the automatic sear; and a helical double-torsion spring disposed adjacent the sear lever and the rear surface of the automatic sear and comprising first and second sets of coils wound in opposing directions and having an unwound portion disposed there between, the first set of coils ending in a tangential leg configured to operatively interface with the safe/fire selector switch of the rifle, and the second set of coils ending in a radial over-center leg; wherein the automatic sear, the sear lever, the helical torsion spring, and the helical double-torsion spring share a rotational axis; wherein the assembly further comprises: a bushing inserted along the axis, the bushing having a slot formed therein; and a pin inserted within the bushing along the axis, the pin having a groove formed therein; wherein the groove and the slot are configured to align when the pin is inserted within the bushing and configured to receive the radial over-center leg of the helical double-torsion spring; and wherein rotational deflection of the sear lever in a first direction about the axis causes the sear lever to rotate away from the rear surface of the automatic sear, and rotational deflection of the sear lever in a second direction about the axis imparts rotation to the automatic sear causing the automatic sear to sear with the hammer of the rifle. In some cases, a rifle including the automatic sear assembly is provided, wherein the rifle is chambered for rounds larger than or equal to .223 caliber rounds (5.56×45 mm NATO rounds).

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

BRIEF DESCRIPTION OF THE DRAWINGS

FIGS. 3A-3D illustrate a sear lever configured in accordance with an embodiment of the present disclosure.

FIGS. 4A-4D illustrate a sear lever spring configured in accordance with an embodiment of the present disclosure.

FIGS. 7A-7C illustrate a bushing configured in accordance with an embodiment of the present disclosure.

FIGS. 8A-8C illustrate a pin configured in accordance with an embodiment of the present disclosure.

Figure 1A:
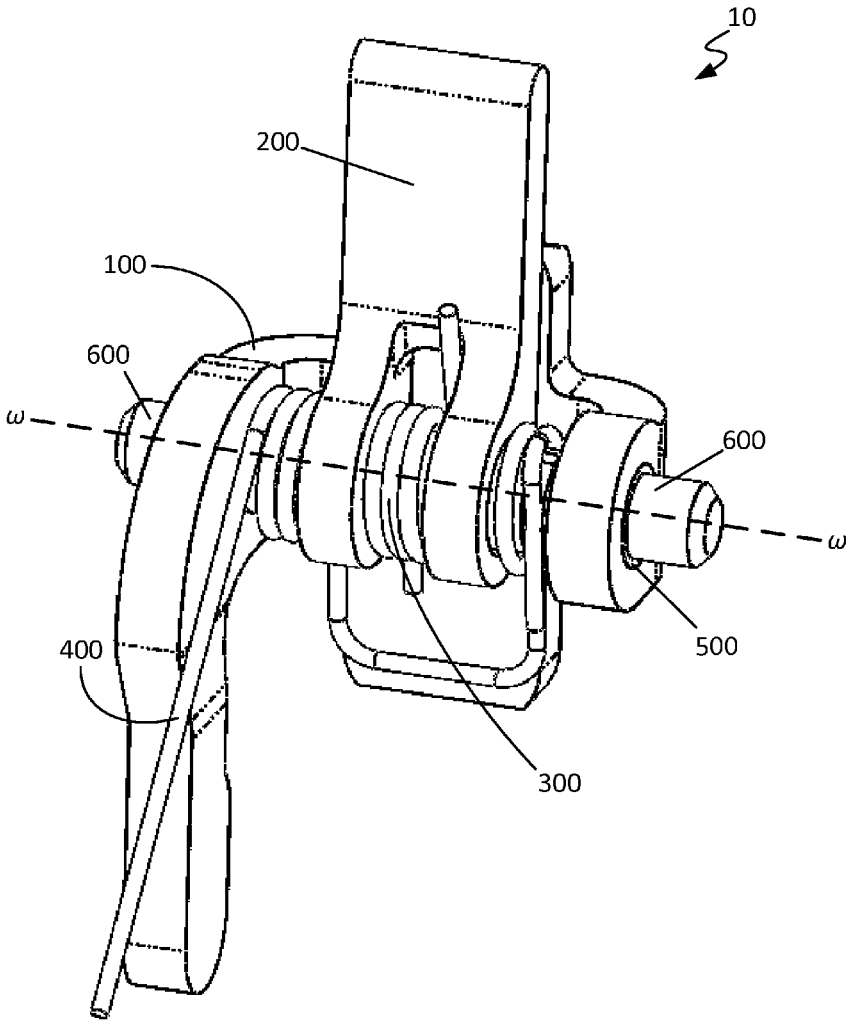
FIG. 1A is a perspective view of a sear assembly configured in accordance with an embodiment of the present disclosure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed subject matter to the specific configurations shown. In short, the figures are provided merely to show example structures.

DETAILED DESCRIPTION

An automatic sear assembly for providing a large-bore rifle with full-automatic firing and/or burst firing capabilities is disclosed. In accordance with some embodiments, the disclosed assembly includes an automatic sear operatively configured with a sear lever which is provided with bidirectional articulation for selectively imparting torque on the automatic sear to cause tripping thereof. For example, the disclosed assembly can be configured such that rotational deflection of the sear lever away from the automatic sear imparts no rotation thereto, whereas rotational deflection of the sear lever toward the automatic sear imparts rotation thereto. Thus, and in accordance with some embodiments, the disclosed sear assembly can be used in a rifle, for example, to utilize the force of a moving bolt carrier during a given firing cycle to initiate a subsequent firing cycle without need to release and once again operate the trigger of the rifle. Numerous configurations and variations will be apparent in light of this disclosure.

General Overview

As previously indicated, there are a number of non-trivial issues that can arise which complicate the ability to provide a large-bore rifle with automatic firing capabilities. For instance, one non-trivial issue pertains to the fact that existing large-bore rifle designs which have selective-fire capabilities use a large and heavy sear lever for tripping the rifle's sear to provide the rifle with a full-automatic firing mode. However, that lever, which is suspended in the rifle's bolt carrier, adds moving mass to the bolt carrier, is prone to failure through the pin which permits the sear lever to pivot, and causes damage to the surface of the lower receiver and receiver extension tube of the host rifle.

Thus, and in accordance with a set of embodiments of the present disclosure, an automatic sear assembly for providing a large-bore rifle with automatic firing capabilities is disclosed. The disclosed sear assembly includes a sear lever configured, in accordance with an embodiment, to be operatively interfaced with a traditional automatic sear. The sear assembly further includes a sear lever spring which, in accordance with an embodiment, biases the sear lever into physical contact with the back of the sear while also permitting the sear lever to be deflected out of such physical contact upon application of sufficient force (e.g., a force in excess of the angular return force of the sear lever spring). Thus, the sear lever of the disclosed assembly is provided with bidirectional articulation which, in accordance with an embodiment, permits its use in selectively imparting torque on the automatic sear. That is, the sear lever is configured to impart rotation to the sear when rotated toward the sear, but to impart no rotation to the sear when rotated away therefrom. Otherwise stated, the sear and the adjacent sear lever of the disclosed assembly are configured, in accordance with an embodiment, to operate independently of one another in the rearward direction but conjunctively in the forward direction.

In accordance with some embodiments, the disclosed automatic sear assembly can be used in a rifle, for example, to harness the force of a moving bolt carrier for purposes of automatically initiating subsequent firing cycle(s). More specifically, the sear lever of the disclosed assembly can be configured, in accordance with an embodiment, to be incident with a bolt carrier and thus transfer the force of its forward motion during a given firing cycle to automatically trip the sear for purposes of initiating a subsequent firing cycle without having to release and again depress the rifle's trigger.

In some instances, the number of automatic firing cycles permitted may be unspecified or otherwise not predetermined (i.e., the rifle may be provided with a full-automatic firing mode). However, the present disclosure is not so limited, as in some other instances, the number of automatic firing cycles permitted may be intentionally limited or otherwise predetermined (i.e., the rifle may be provided with a burst-firing mode). In such cases, the permitted quantity/grouping of automatic firing cycles (e.g., two, three, four, or any other specified quantity greater than one) may be designated as desired for a given target application or end-use.

In any case, and in accordance with some embodiments, the disclosed sear assembly can be operatively coupled, for example, with the safe/fire selector switch of a rifle without interfering with the rifle's traditional semi-automatic firing capabilities and/or safe mode. Thus, the safe/fire selector switch of a rifle which includes the disclosed automatic sear assembly can be toggled, for example, to put the rifle into any of several modes, including: a full-automatic firing mode; a burst-firing mode (if applicable); a semi-automatic firing mode; and/or a safe mode. Numerous configurations will be apparent in light of this disclosure.

Some embodiments can be utilized, for example, to provide full-automatic firing and/or burst firing capabilities for a rifle which is chambered for .308 caliber rounds (7.62×51 mm NATO rounds), such as the SIG716® rifle produced by Sig Sauer, Inc. However, the present disclosure is not so limited. For instance, other embodiments can be utilized to provide such capabilities, for example, in a rifle which is chambered for .30-06 caliber rounds (7.62×63 mm rounds). In a more general sense, an automatic sear assembly configured as described herein can be used, in accordance with some embodiments, in any large-bore rifle chambered for rounds larger than or equal to a .223 caliber round (5.56×45 mm NATO round).

As will be appreciated in light of this disclosure, some embodiments may realize benefits or advantages as compared to existing approaches. For instance, in some embodiments, the disclosed automatic sear assembly can be configured such that its sear lever is allowed to move rearward and forward in each firing cycle, but prevented from functioning to trip the automatic sear, for example, when the host rifle is put in a semi-automatic firing mode or safe mode. More particularly, the automatic sear of the disclosed assembly can be rotated into and out of index with the rifle's hammer/striker (e.g., by toggling the host rifle's safe/fire selector switch), and thus by virtue of how the sear lever and sear are operatively interfaced, the sear lever can be permitted and prevented, respectively, from operating to trip the sear. In turn, this can obviate the need to include additional componentry for purposes of preventing unwanted tripping of the sear by the sear lever, which can help to reduce mechanical complexity and/or improve mechanical reliability of the host rifle.

In some embodiments, the disclosed automatic sear assembly can be configured with a sear lever which aids in preventing the sear from coming into direct physical contact with the bolt carrier of the rifle. In turn, this can help to eliminate or otherwise reduce the likelihood of causing the host rifle to bind during full-automatic and/or burst firing. Also, some embodiments may utilize small form factor components constructed from materials which are lightweight, resilient, inexpensive, etc. In some such instances, minimal (or otherwise negligible) mass and/or bulk may be added to the host rifle, thereby helping to maintain a reliable, lightweight, compact firearm. Also, in some instances, a reduction in cost (e.g., of production, of repair, of replacement, etc.) may be realized.

In some cases, and in accordance with an embodiment, a sear assembly provided using the disclosed techniques can be configured, for example, as: (1) a partially/completely assembled automatic sear assembly unit; and/or (2) a kit or other collection of discrete components (e.g., an automatic sear, a sear spring, a sear lever, a sear lever spring, a bushing, a pin, etc., as variously described herein) which may be operatively coupled as desired.

As will be appreciated in light of this disclosure, and in accordance with an embodiment, use of the disclosed automatic sear assembly may be detected, for example, by visual inspection of a rifle having automatic (full-automatic and/or burst) firing capabilities and chambered for rounds larger than or equal to a .223 caliber round (5.56×45 mm NATO round).

Structure and Operation

Figure 1B:
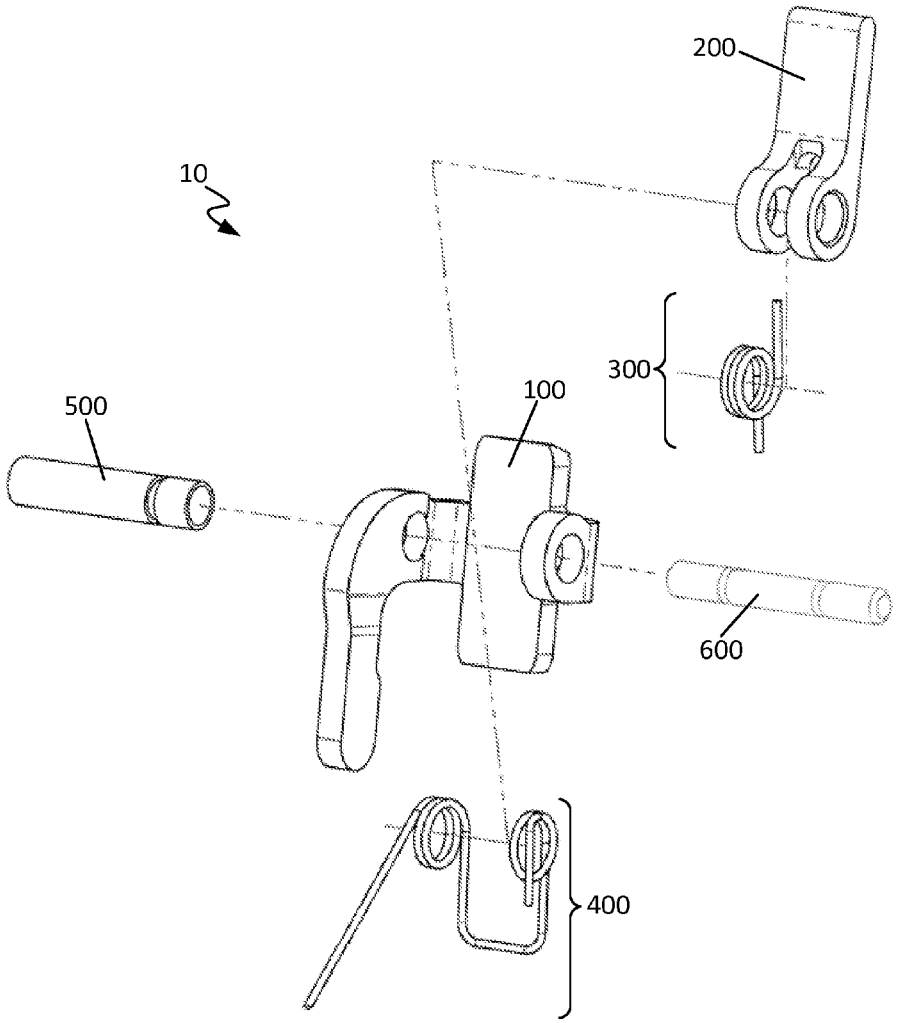
FIG. 1B is an exploded view of a sear assembly configured in accordance with an embodiment of the present disclosure.

FIGS. 1A and 1B are a perspective view and an exploded view, respectively, of a sear assembly 10 configured in accordance with an embodiment of the present disclosure. As can be seen, assembly 10 includes an automatic sear 100 and an adjacent sear lever 200. A sear lever spring 300 is disposed adjacent to sear lever 200 and sear 100 and serves to help operatively interface sear lever 200 and sear 100, as discussed below. Also, a sear spring 400 is disposed adjacent to sear lever 200 and sear 100 and serves to help operatively couple sear assembly 10 with the safe/fire selector switch of a rifle (e.g., such as the safe/fire selector switch 930 of rifle 900, discussed below with reference to FIGS. 10A-10B). As can further be seen, a bushing 500 is inserted along the rotational axis ω shared by each of automatic sear 100, sear lever 200, sear lever spring 300, and sear spring 400, and a pin 600 is inserted within bushing 500 along the same rotational axis ω. Each of these components is discussed in detail below.

In some embodiments, sear assembly 10 can be utilized, for example, in a rifle that is chambered for .308 caliber rounds (7.62×51 mm NATO rounds), such as the SIG716® rifle produced by Sig Sauer, Inc. However, the present disclosure is not so limited. For instance, in some other embodiments, sear assembly 10 can be utilized, for example, in a rifle that is chambered for .30-06 caliber rounds (7.62×63 mm rounds). In a more general sense, and in accordance with a set of embodiments, sear assembly 10 can be operatively installed within a rifle that is chambered, for example, for rounds which are larger than or equal to a .223 caliber round (a 5.56×45 mm NATO round). Other suitable uses will be apparent in light of this disclosure.

Figure 2A:
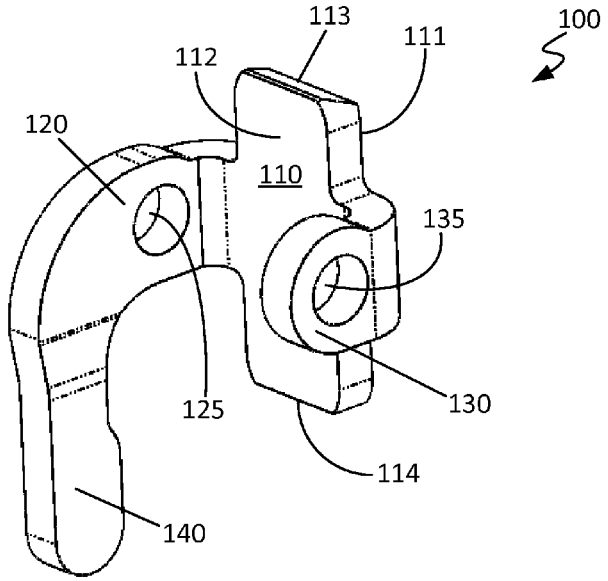
FIGS. 2A and 2B illustrate an automatic sear configured in accordance with an embodiment of the present disclosure.
Figure 2B:
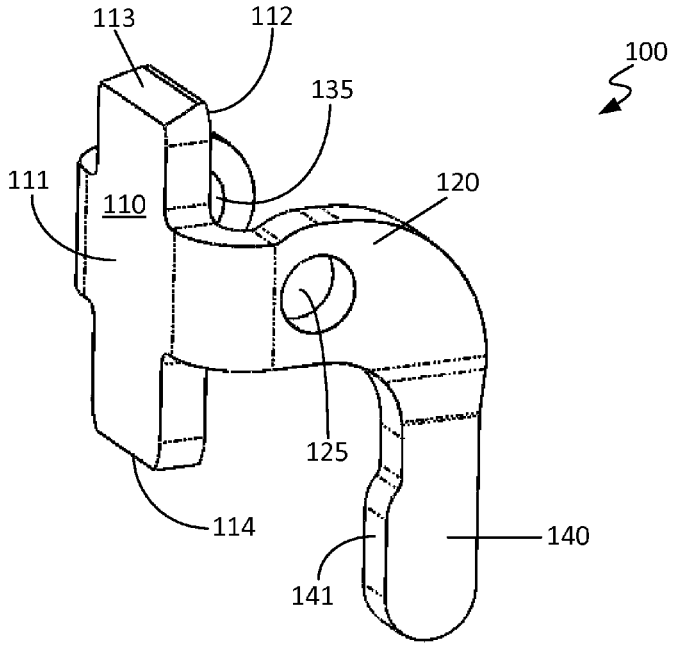
Figure 5A:
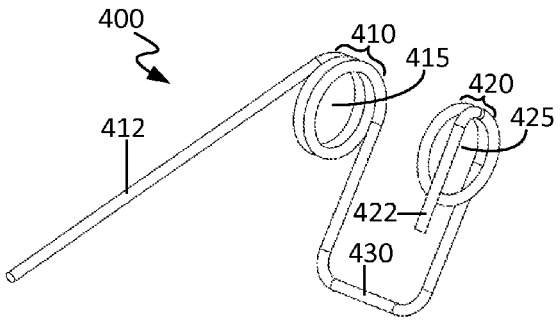
FIGS. 5A-5D illustrate a sear spring configured in accordance with an embodiment of the present disclosure.
Figure 5B:
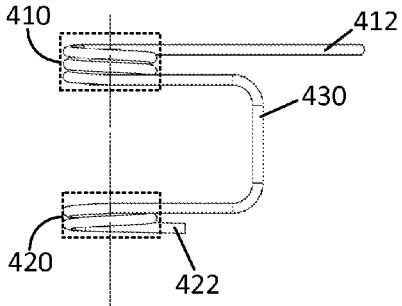
Figure 5D:
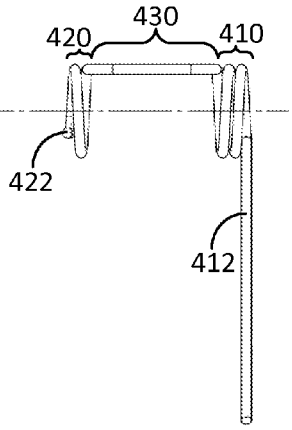
Figure 5C:
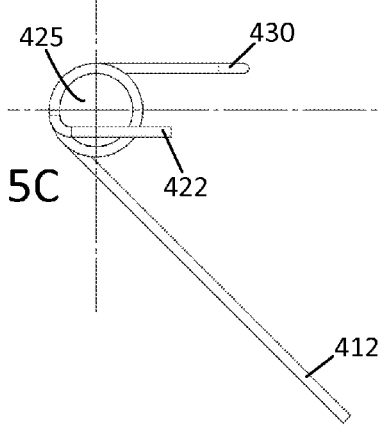

FIGS. 2A and 2B illustrate an automatic sear 100 configured in accordance with an embodiment of the present disclosure. In some instances, sear 100 can be, for example, a standard automatic sear which is traditionally used in providing automatic firing capabilities for rifles chambered for rounds of a caliber equal to or less than .223 (less than 5.56×45 mm NATO). However, the present disclosure is not so limited, as in some other embodiments, sear 100 may be configured as a non-traditional and/or custom automatic sear, as desired for a given target application or end-use. As depicted, sear 100 includes an actuating portion 110 having a front surface 111, a rear surface 112, an upper surface 113, and a lower surface 114. As will be appreciated in light of this disclosure, lower surface 114 is configured to sear with the hammer/striker mechanism of a rifle (e.g., such as the hammer 940 of rifle 900, discussed below). Also, rear surface 112 is configured, in accordance with an embodiment, to interface with a sear lever 200, as discussed below.

As can further be seen, side portions 120 and 130 extend rearward from actuating portion 110 and are positioned opposite one another across the breadth of sear 100. Also, side portion 120 has an aperture 125 formed therein, and side portion 130 has a similar aperture 135 formed therein. As apertures 125 and 135 help to define the rotational axis ω about which sear 100 and other portions of assembly 10 rotate during operation, it may be desirable to ensure that side portions 120 and 130 are substantially parallel with one another and that their respective apertures 125 and 135 are substantially aligned with one another (e.g., exactly aligned or otherwise within an acceptable tolerance) across the breadth of sear 100. Also, it may be desirable to ensure that apertures 125 and 135 are suitably dimensioned, for example, to receive and retain bushing 500 and pin 600, discussed below.

Also, as can be seen, side portion 120 further includes an arm portion 140 extending downwardly therefrom. Arm portion 140 has a front surface 141 which is configured to operatively interface with a safe/fire selector switch of a rifle (e.g., such as the safe/fire selector switch 930 of rifle 900, discussed below) such that toggling of the safe/fire selector switch moves sear 100 into and out of index with the hammer/striker of the host rifle (e.g., such as hammer 940, discussed below), in accordance with an embodiment.

Sear 100 can be constructed from any suitable material, as will be apparent in light of this disclosure. For instance, in some embodiments, sear 100 can be constructed from AISI 8620 alloy steel. In a more general sense, sear 100 can be constructed from any suitable material which is compliant, for example, with United States Defense Standard MIL-W-13855 (Weapons: Small Arms and Aircraft Armament Subsystems, General Specification For). Also, in some instances, sear 100 can be dimensioned and oriented within a rifle as traditionally done. Other suitable configurations and materials for sear 100 will depend on a given application and will be apparent in light of this disclosure.

FIGS. 3A-3D illustrate a sear lever 200 configured in accordance with an embodiment of the present disclosure. As can be seen, sear lever 200 includes an upper portion 210 which, in accordance with an embodiment, is configured to come into physical contact with the bolt carrier of a rifle (e.g., such as bolt carrier 920 of rifle 900, discussed below). Upper portion 210 terminates in an upper end 212, which may be rounded or otherwise have a curvature, for example, to facilitate smooth physical interaction between sear lever 200 and an incident bolt carrier.

Also, as can be seen, upper portion 210 transitions to a middle portion 220 having a recess 222 formed therein. In accordance with an embodiment, recess 222 can be configured with a curvature, angle, and/or depth which provide a smooth/unsharpened contact surface, for example, for sear lever spring 300, discussed below. In some instances, this may help to improve the mechanical reliability of sear lever spring 300 (e.g., improve its resistance to cutting/shearing and consequent fracture).

On either side of recess 222, middle portion 220 transitions to base portions 230 and 240 which are positioned opposite one another across the breadth of sear lever 200. Base portion 230 has an aperture 235 formed therein, and base portion 240 has a similar aperture 245 formed therein. In some cases, aperture 235 optionally may include a countersink feature 237; aperture 245 similarly may include an optional countersink feature 247. When included, optional countersink features 237/247 may help to: (1) facilitate insertion/removal, for example, of bushing 500 (discussed below) and thus contribute to the ease of assembly/disassembly of sear assembly 10; and/or (2) reduce the stresses experienced by apertures 235/245 resulting from interaction between sear lever 200 and a bolt carrier incident therewith during a given firing cycle.

As apertures 235 and 245 help to define the rotational axis ω about which sear lever 200 and other portions of assembly 10 rotate during operation, it may be desirable to ensure that base portions 230 and 240 are substantially parallel with one another and that their respective apertures 235 and 245 are substantially aligned with one another (e.g., exactly aligned or otherwise within an acceptable tolerance) across the breadth of sear lever 200, as well as with apertures 125 and 135 of sear 100 (discussed above). Also, it may be desirable to ensure that apertures 235 and 245 are suitably dimensioned, for example, to receive and retain bushing 500 and pin 600, discussed below.

Sear lever 200 can be constructed from any suitable material, as will be apparent in light of this disclosure. For instance, in some embodiments, sear lever 200 can be constructed from AISI 8620 alloy steel. In a more general sense, sear lever 200 can be constructed from any suitable material which is compliant, for example, with United States Defense Standard MIL-W-13855 (Weapons: Small Arms and Aircraft Armament Subsystems, General Specification For). Other suitable materials for sear lever 200 will depend on a given application and will be apparent in light of this disclosure.

Also, sear lever 200 can be dimensioned as desired for a given target application or end-use. For example, in some embodiments, sear lever 200 can be dimensioned such that its width is about the same (e.g., within ±5%) as that of actuating portion 110 of automatic sear 100. In some embodiments, sear lever 200 can be dimensioned such that its length extends beyond upper surface 113 of actuating portion 110, for example, by a distance in the range of about ⅛ to ½ inch or greater. In a more general sense, and in accordance with an embodiment, the dimensions of sear lever 200 can be customized, for example, to provide the desired operative interfacing between sear lever 200 (e.g., at upper end 212 thereof) and the bolt carrier utilized in the host rifle. For instance, the length of sear lever 200 can be customized to accommodate bolt carriers of various sizes, which may depend, at least in part, on the caliber of rounds for which the host rifle is chambered. Numerous suitable configurations will be apparent in light of this disclosure.

As previously noted, sear lever 200 is operatively interfaced with the rear surface 112 of actuating portion 110 of sear 100. In accordance with an embodiment, this operative interfacing is assisted by a sear lever spring 300. FIGS. 4A-4D illustrate a sear lever spring 300 configured in accordance with an embodiment of the present disclosure. As can be seen, sear lever spring 300 can be generally configured as a helical tangential torsion spring including a set of coils 310 which end in a first leg 312 and a second leg 314. While the depicted example embodiment shows sear lever spring 300 having straight legs 312 and 314, the present disclosure is not so limited. For instance, in another example embodiment, sear lever spring 300 may be provided with legs 312 and/or 314 having curvature (e.g., slightly curved legs 312 and/or 314). In any case, the number of turns of coils 310, direction of winding, and pitch thereof can be customized as desired for a given target application or end-use. In the depicted example embodiment, coil set 310 includes three turns which are right-hand, close-wound (e.g., have a tight pitch). Numerous suitable configurations will be apparent in light of this disclosure.

The inner diameter of coils 310 defines a center space 315 therein and can be varied as desired for a given target application or end-use. For instance, in some embodiments, coils 310 may have an inner diameter in the range of about 0.1-0.5 inches or greater. However, it may be desirable to ensure that center space 315 is suitably dimensioned, for example, to receive and retain bushing 500 and pin 600, discussed below. Also, as center space 315 helps to define the rotational axis ω about which sear lever spring 300 operates (and about which other portions of assembly 10 are rotated during operation), it may be desirable to ensure that center space 315 is substantially aligned (e.g., exactly aligned or otherwise within an acceptable tolerance) with apertures 235 and 245 of sear lever 200, as well as with apertures 125 and 135 of sear 100.

Sear lever spring 300 can be constructed from any suitable material, as will be apparent in light of this disclosure. For instance, in some embodiments, sear lever spring 300 can be constructed from 17-7PH stainless steel. In some other embodiments, sear lever spring 300 can be constructed, for example, from spring steel. As will be appreciated in light of this disclosure, it may be desirable in some instances to ensure that sear lever spring 300 comprises a material, for example, which is corrosion-resistant, reliable over a large temperature range (e.g., −50° F. to 170° F.), and/or resistant to cyclic fatigue. In a more general sense, sear lever spring 300 can be constructed from any suitable material which is compliant, for example, with United States Defense Standard MIL-W-13855 (Weapons: Small Arms and Aircraft Armament Subsystems, General Specification For). Other suitable materials for sear lever spring 300 will depend on a given application and will be apparent in light of this disclosure.

As previously noted, and in accordance with an embodiment, sear lever spring 300 is configured to assist in operatively interfacing sear lever 200 with sear 100. To that end, sear lever spring 300 can be configured to provide an angular return force which is sufficient to bias sear lever 200 into physical contact with the rear surface 112 of actuating portion 110 of sear 100 in one direction while also allowing sear lever 200 to be deflected away from such physical contact in the opposing direction. By virtue of this configuration, and in accordance with an embodiment, sear lever 200 is permitted to be rotationally deflected away from actuating portion 110 (e.g., upper portion 210 can be taken out of physical contact with rear surface 112) in the rearward rotating direction, and thus sear lever 200 rotates rearward without imparting rotation to sear 100. Conversely, sear lever 200 is permitted to be rotationally deflected toward actuating portion 110 (e.g., physical contact between upper portion 210 and rear surface 112 can be restored) in the forward rotating direction, and thus sear lever 200 can be used to impart torque on (and thus rotation to) sear 100 in the forward direction. As discussed below with reference to FIGS. 10A-10B, and in accordance with an embodiment, this bidirectional articulation permits sear lever 200 to transmit to sear 100, as torque, the force imparted by a forward-moving bolt carrier 920 that is incident with sear lever 200.

Also, as previously noted, sear assembly 10 can be operatively coupled with the safe/fire selector switch of a rifle. To that end, and in accordance with an embodiment, sear assembly 10 includes a sear spring 400. FIGS. 5A-5D illustrate a sear spring 400 configured in accordance with an embodiment of the present disclosure. As can be seen, sear spring 400 can be generally configured as a helical double-torsion spring including a first set of coils 410 which transitions to an unwound portion 430, which in turn transitions to a second set of coils 420 that is positioned opposite of coil set 410. The inner diameter of coils 410 and 420 respectively define center spaces 415 and 425 therein and can be varied as desired for a given target application or end-use. For instance, in some embodiments, coils 410 and/or 420 may have an inner diameter in the range of about 0.1-0.5 inches or greater. However, it may be desirable to ensure that center spaces 415 and 425 are suitably dimensioned, for example, to receive and retain bushing 500 and pin 600, discussed below. Also, as center spaces 415 and 425 help to define the rotational axis ω about which sear spring 400 operates (and about which other portions of assembly 10 are rotated during operation), it may be desirable to ensure that center spaces 415 and 425 are substantially aligned with one another (e.g., exactly aligned or otherwise within an acceptable tolerance) across the breadth of sear spring 400, as well as with center space 315 of sear lever spring 300, apertures 235 and 245 of sear lever 200, and apertures 125 and 135 of sear 100.

In the depicted example embodiment, coil set 410 includes 2⅜ turns which are left-hand wound with a relaxed pitch (e.g., adjacent turns of coil set 410 have a relatively expanded pitch as compared to coil set 310). Also, as depicted, coil set 420 includes 1¼ turns which are right-hand wound with a relaxed pitch similar to that of coil set 410 (e.g., adjacent turns of coil set 420 have a relatively expanded pitch as compared to coil set 310). In some cases, providing coil sets 410 and 420 which have a relatively expanded pitch may help, for example, to: (1) minimize or otherwise reduce friction between adjacent turns of a given coil set 410/420; and/or (2) keep sear lever 200 roughly centered in relation to actuating portion 110 by limiting lateral movement of sear lever 200 about rotational axis ω, and thus help to maintain the desired physical interfacing between sear 200 and rear surface 112. However, the present disclosure is not so limited, as the number of turns within coil sets 410 and 420, the directions of winding, and the pitch thereof can be customized as desired for a given target application or end-use, in accordance with other embodiments. In any case, it may be desirable to ensure that coil sets 410 and 420 are wound, for example, in opposing directions to provide a sear spring 400 which exhibits the desired double-torsion performance. Numerous suitable configurations will be apparent in light of this disclosure.

As can further be seen, coil set 410 ends in a tangential leg 412, and coil set 420 ends in a radial over-center leg 422. While the depicted example embodiment shows sear spring 400 having straight legs 412 and 422, the present disclosure is not so limited. For instance, in another example embodiment, sear spring 400 may be provided with legs 412 and/or 422 having curvature (e.g., slightly curved legs 412 and/or 422). In the figures, leg 422 extends substantially parallel to unwound portion 430 (e.g., exactly parallel or otherwise within an acceptable tolerance), whereas leg 412 is provided with an angular offset as compared to leg 422 (e.g., legs 412 and 422 can have a non-zero free angle). For example, consider FIG. 5C, which shows legs 412 and 422 as having a free angle of about 45° (e.g., 45°±5°), in accordance with an embodiment. In some cases, this angular offset of leg 412 may contribute, for example, to achieving the desired amount of preloading of sear spring 400 when sear assembly 10 is operatively coupled with the safe/fire selector switch of a rifle, in accordance with an embodiment. It should be noted, however, that the present disclosure is not so limited, and sear springs 400 including legs 412 and 422 exhibiting greater or lesser free angles (if any) may be provided as desired in other embodiments.

Figure 6A:
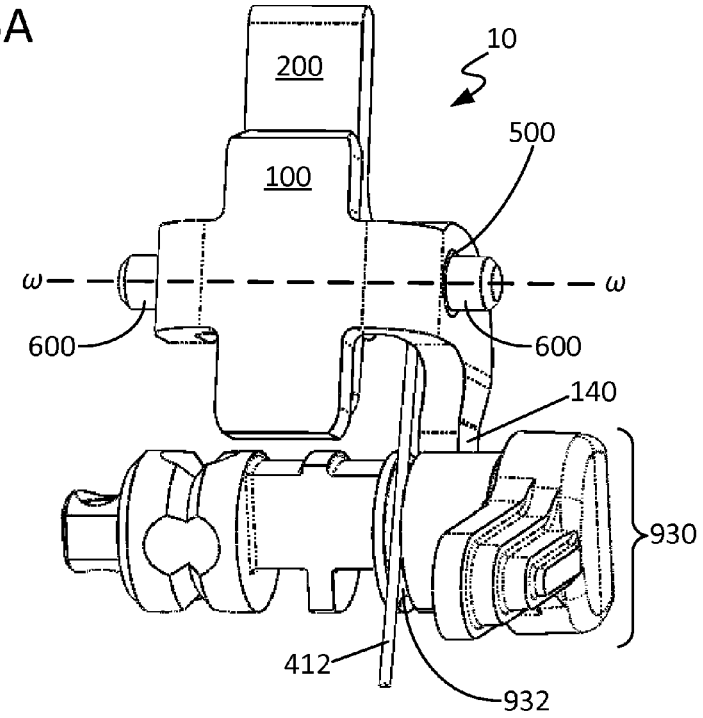
FIG. 6A is a front perspective view illustrating a sear assembly operatively coupled with a safe/fire selector switch, in accordance with an embodiment of the present disclosure.
Figure 6B:
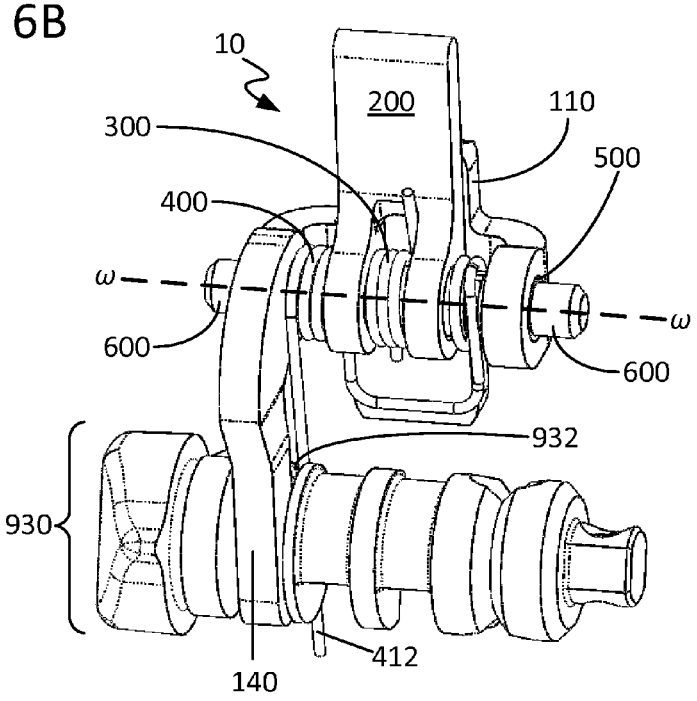
FIG. 6B is a rear perspective view illustrating a sear assembly operatively coupled with a safe/fire selector switch, in accordance with an embodiment of the present disclosure.

In accordance with an embodiment, the dimensions (e.g., lengths, thicknesses, etc.) of legs 412 and 422 can be customized as desired for a given target application or end-use. However, as will be appreciated in light of this disclosure, it may be desirable to ensure that the length of leg 412 is sufficient to provide the desired operative interfacing between leg 412 and the safe/fire selector switch of the host rifle (e.g., such as at groove 932 of safe/fire selector switch 930, discussed below with reference to FIGS. 6A-6B). Also, as can be seen in the figures, leg 422 is provided with a length that is comparatively shorter than the length of leg 412 and the length of unwound portion 430. However, as will be further appreciated, it may be desirable to ensure that the length of leg 422 is sufficient to provide the desired operative interfacing between leg 422 and slot 502/groove 602, as discussed below with reference to FIGS. 9A-9B. Numerous suitable configurations will be apparent in light of this disclosure.

Sear spring 400 can be constructed from any suitable material, as will be apparent in light of this disclosure. For instance, in some embodiments, sear spring 400 can be constructed from 17-7PH stainless steel. In some other embodiments, sear spring 400 can be constructed, for example, from spring steel. As will be appreciated in light of this disclosure, it may be desirable in some instances to ensure that sear spring 400 comprises a material, for example, which is corrosion-resistant, reliable over a large temperature range (e.g., −50° F. to 170° F.), and/or resistant to cyclic fatigue. In a more general sense, sear spring 400 can be constructed from any suitable material which is compliant, for example, with United States Defense Standard MIL-W-13855 (Weapons: Small Arms and Aircraft Armament Subsystems, General Specification For). Other suitable materials for sear spring 400 will depend on a given application and will be apparent in light of this disclosure.

As previously noted, and in accordance with an embodiment, sear spring 400 is configured to assist in operatively coupling sear assembly 10 with a safe/fire selector switch of a rifle. For example, consider FIGS. 6A and 6B, which are front and rear perspective views, respectively, illustrating a sear assembly 10 operatively coupled with a safe/fire selector switch 930, in accordance with an embodiment of the present disclosure. As can be seen, switch 930 has a groove 932 formed therein which is configured to receive and retain leg 412 of sear spring 400. In accordance with an embodiment, leg 412 can be deflected against its restoring force and maneuvered into a seated engagement within groove 932 of switch 930, thus putting sear spring 400 in a preloaded state. As previously noted, the free angle offset of leg 412 can be customized as desired for a given target application or end-use, and thus greater or lesser amounts of preloading can be achieved, in accordance with some embodiments. As can further be seen from these figures, arm portion 140 of sear 100 is operatively interfaced at its surface 141 (not visible) with safe/fire selector switch 930. As a result, and in accordance with an embodiment, toggling of switch 930 (e.g., such as by rotation thereof) serves to change the angle of sear 100 about rotational axis ω, thus bringing sear 100 into and out of index, for example, with the hammer/striker of the host rifle (e.g., such as hammer 940 of rifle 900, discussed below), consequently changing the firing mode thereof. Thus, in a sense, the operative interfacing between arm portion 140 and safe/fire selector switch 930 contributes to enabling/disabling functional interaction between sear lever 200 and sear 100, in accordance with an embodiment.

As previously noted, sear assembly 10 also includes a bushing 500 and a pin 600 which is inserted therein. FIGS. 7A-7C illustrate a bushing 500 configured in accordance with an embodiment of the present disclosure, and FIGS. 8A-8C illustrate a pin 600 configured in accordance with an embodiment of the present disclosure. As can be seen, bushing 500 can be generally configured as a substantially cylindrical tube having one or more slots/recesses 502 formed therein and having open ends 505 spaced distally from one another along the length of bushing 500. A particular slot 502 can be positioned anywhere along the length of bushing 500, and in some instances may be formed proximate one of the open ends 505. As can further be seen, pin 600 can be generally configured as a cylindrical rod having one or more grooves 602 formed therein and having ends 604 spaced distally from one another along the length of pin 600. A particular groove 602 can be positioned anywhere along the length of pin 600, and in some instances may be located so as to substantially align with a slot 502 when pin 600 is inserted within bushing 500. Also, pin 600 can be configured to be operatively coupled, for example, with the lower receiver of a rifle (e.g., such as the lower receiver 910 of rifle 900, discussed below). It should be noted that, while pin 600 is generally referred to herein as a 'pin' for consistency and ease of understanding of the present disclosure, pin 600 is not so limited to that specific terminology and alternatively can be referred to as a shaft, arbor, or mandrel in other embodiments, as will be appreciated in light of this disclosure.

Bushing 500 and pin 600 can be constructed from any suitable material(s), as will be apparent in light of this disclosure. For instance, in some embodiments, bushing 500 can be constructed from AISI 303 stainless steel. In some other embodiments, bushing 500 can be constructed, for example, from ASTM A484 stainless steel. In some example embodiments, pin 600 can be constructed from AISI 4130 steel. In some other embodiments, pin 600 can be constructed, for example, from AISI 4140 steel. In a more general sense, bushing 500 and pin 600 can be constructed from any suitable material(s) which are compliant, for example, with United States Defense Standard MIL-W-13855 (Weapons: Small Arms and Aircraft Armament Subsystems, General Specification For). Other suitable materials for bushing 500 and pin 600 will depend on a given application and will be apparent in light of this disclosure.

In accordance with an embodiment, the dimensions (e.g., length, sidewall thickness, inner diameter/width, outer diameter/width, etc.) of bushing 500 can be customized as desired for a given target application or end-use. However, as will be appreciated in light of this disclosure, it may be desirable to ensure that bushing 500 has a suitable outer diameter which permits it to be inserted along rotational axis ω within the axial space defined by apertures 125 and 135 of sear 100, center spaces 415 and 425 of sear spring 400, apertures 235 and 245 of sear lever 200, and center space 315 of sear lever spring 300, as previously discussed. Also, it may be desirable to ensure that bushing 500 has a suitable outer diameter that provides sufficient clearance between bushing 500 and both of sear lever spring 300 and sear spring 400 to prevent binding of those springs during deflection thereof. For instance, in one example embodiment, bushing 500 may have an outer diameter that is about 90% or less of the inner diameter of coil sets 310, 410, and 420. As will be further appreciated, it may desirable to ensure that bushing 500 has a suitable length such that its open ends 505 are substantially flush with the outer surfaces of side portions 120 and 130 of sear 100. Furthermore, as can be seen with reference to FIG. 7B, for example, a given slot 502 can be dimensioned so that it cuts through the full thickness of the sidewall of bushing 500 but does not cut through the full circumference of bushing 500. Also, a given slot 502 can be suitably dimensioned (e.g., of sufficient width, length, and depth) to receive and retain leg 422 of sear spring 400, as discussed below with reference to FIG. 9A-9B.

In accordance with an embodiment, the dimensions (e.g., length, diameter/width, etc.) of pin 600 can be customized as desired for a given target application or end-use. However, as will be appreciated in light of this disclosure, it may be desirable to ensure that pin 600 has a suitable diameter/width which permits it to be inserted within bushing 500. As will be further appreciated, it may desirable to dimension pin 600 so that its ends 604 extend beyond the open ends 505 of bushing 500, as well as beyond the outer surfaces of side portions 120 and 130 of sear 100, thereby permitting pin 600 to be operatively coupled, for example, with the lower receiver of the host rifle (e.g., such as the lower receiver 910 of rifle 900, discussed below). In some embodiments, ends 604 of pin 600 may have chamfered edges 607, for example, to help with the ease of insertion of pin 600 within bushing 500 (e.g., which may facilitate easy assembly of sear assembly 10). Also, a given groove 602 can be suitably dimensioned (e.g., of sufficient width and depth) to permit leg 422 of sear spring 400 to be seated therein, as discussed below.

Figure 9A:
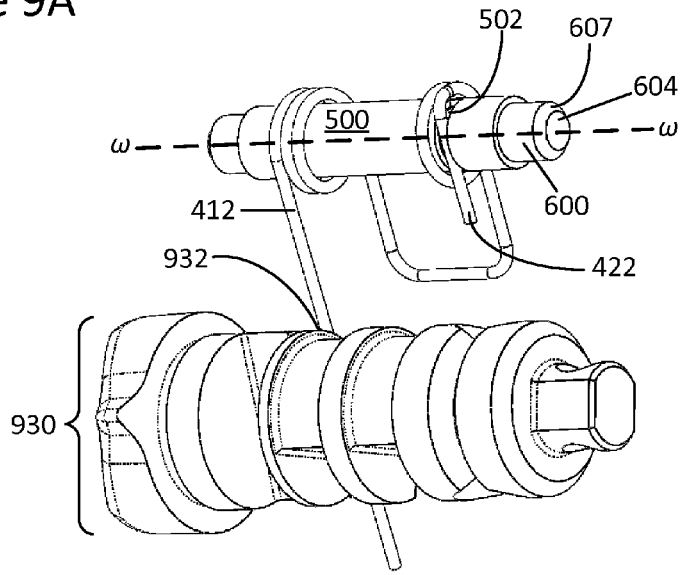
FIG. 9A is a rear perspective view illustrating a bushing, a pin, and a sear spring as isolated from other portions of a sear assembly and operatively interfaced with a safe/fire selector switch, in accordance with an embodiment of the present disclosure.
Figure 9B:
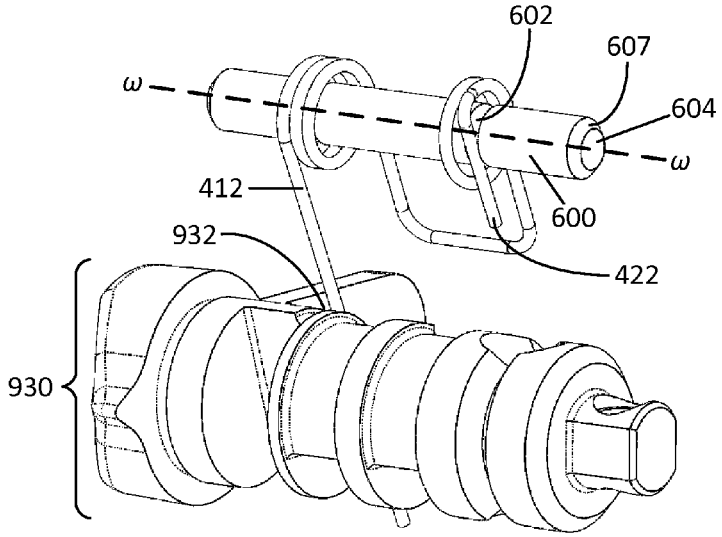
FIG. 9B is a rear perspective view illustrating a pin and a sear spring as isolated from other portions of a sear assembly and operatively interfaced with a safe/fire selector switch, in accordance with an embodiment of the present disclosure.

FIG. 9A is a rear perspective view illustrating bushing 500, pin 600, and sear spring 400 as isolated from other portions of sear assembly 10 and operatively interfaced with a safe/fire selector switch 930 in accordance with an embodiment of the present disclosure. Similarly, FIG. 9B is a rear perspective view showing pin 600 and sear spring 400 as isolated from other portions of sear assembly 10 and operatively interfaced with a safe/fire selector switch 930 in accordance with an embodiment of the present disclosure. As can be seen from these figures, leg 422 of sear spring 400 can be permitted to extend into the bore of bushing 500 at slot 502 and to be brought into seated engagement with groove 602 of pin 600. To that end, and as previously discussed, it may be desirable to ensure that leg 422, slot 502, and groove 602 are suitably dimensioned to provide the desired interfacing.

As will be appreciated in light of this disclosure, sear spring 400 may be limited in its ability to move laterally along rotational axis ω, for example, by virtue of: (1) the physical location of its coil sets 410 and 420 on either side of sear lever 200 and between side portions 120 and 130 of sear 100; and (2) the physical contact between its leg 412 and groove 932 of safe/fire selector switch 930, which is fixed in location within the host rifle. As will be further appreciated, bushing 500 may be limited in its ability to move laterally along rotational axis ω, for example, by virtue of its location between the interior walls of the lower receiver of the host rifle (e.g., such as the lower receiver 910 of rifle 900, discussed below). Also, as will be appreciated, permitting leg 422 to extend through the bore of bushing 500 at slot 502 and to become seated within groove 602 can help to limit pin 600 in its ability to move laterally within the axial space in which it resides (i.e., along rotational axis ω) relative to the lower receiver of the host rifle (e.g., such as the lower receiver 910 of rifle 900, discussed below). In some cases, this can help to ensure retention of pin 600 by the host rifle (e.g., pin 600 may be prevented from inadvertently falling out of rifle 900). Furthermore, and in accordance with an embodiment, the dimensions of bushing 500 and/or automatic sear 100 can help to maintain the desired positioning of sear assembly 10 within the host rifle and/or maintain the desired spatial arrangement of the components of sear assembly 10 relative to one another.

Figure 10A:
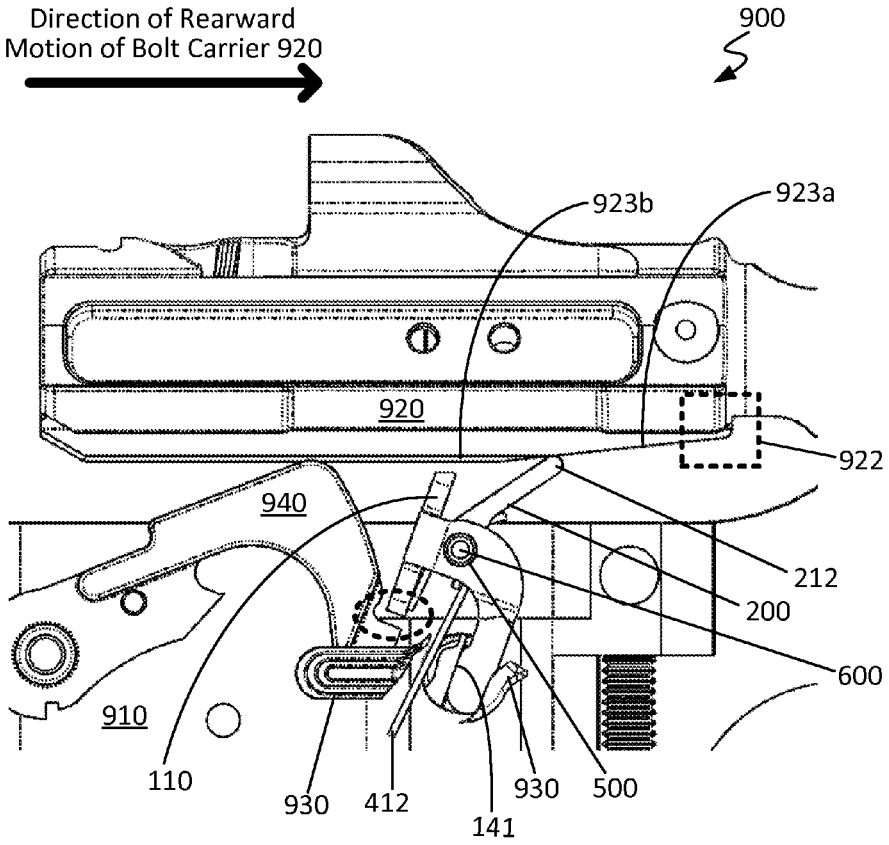
FIGS. 10A and 10B are partial cutaway views of a rifle illustrating interaction between a sear assembly and a bolt carrier during rearward movement and forward movement thereof, respectively, in accordance with an embodiment of the present disclosure.
Figure 10B:
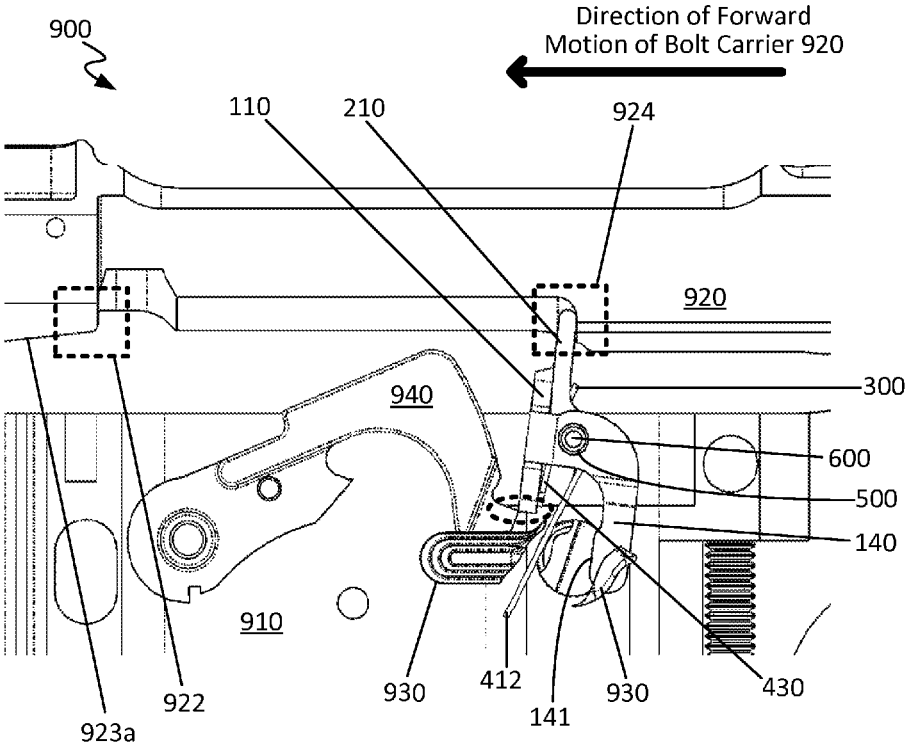

FIGS. 10A and 10B are partial cutaway views of a rifle 900 illustrating interaction between sear assembly 10 and a bolt carrier 920 during rearward movement and forward movement thereof, respectively, in accordance with an embodiment of the present disclosure. As can be seen in FIG. 10A, during rearward movement of bolt carrier 920 (i.e., towards the rear of rifle 900), upper end 212 of sear lever 200 first comes into physical contact with bolt carrier 920 at edge region 922 thereof. Accordingly, sear lever 200 is deflected rearward about rotational axis ω and out of physical contact with the rear surface 112 of actuating portion 110 of sear 100. As sear lever 200 rotates away independently of automatic sear 100, it does so without imparting rotation to sear 100. That is, while rearward deflection of sear lever 200 may impart some torque on sear 100 through sear lever spring 300, sear 100 is substantially prevented from rotating by virtue of the physical contact, for example, between safe/fire selector switch 930 and arm portion 140 (e.g., at surface 141 thereof). As bolt carrier 920 continues to move rearward, upper end 212 of sear lever 200 slides against lower surface 923*a* of bolt carrier 920 (and in some instances, subsequently against lower surface 923*b*), and rearward deflection of sear lever 200 continues. During the rearward deflection of sear lever 200, automatic sear 100 is momentarily out of contact with hammer 940, as can be seen in the dashed ellipse in FIG. 10A.

Thereafter, bolt carrier 920 begins its return trip toward the front of rifle 900. As edge region 922 now passes forward beyond sear lever 200, sear lever 200 is taken out of contact with bolt carrier 920. Upon interruption of such contact, the angular return force of sear lever spring 300 serves to restore physical contact between sear lever 200 and the rear surface 112 of actuating portion 110 of sear 100, as previously discussed. Subsequently in the return trip of bolt carrier 920, edge region 924 thereof comes into physical contact with sear lever 200 at upper portion 210/upper end 212, as can be seen in FIG. 10B. As sear lever 200 previously has been returned into physical contact with actuating surface 110, forward deflection of sear lever 200 accordingly causes sear 100 to deflect in tandem. That is, forward deflection of sear lever 200 serves to transmit the force of the returning bolt carrier 920 to sear 100 as a torque, thereby causing sear 100 to rotate about rotational axis ω (e.g., by virtue of the configuration of sear 100, top surface 113 rotates forward while bottom surface 114 and arm portion 140 rotate rearward). Upon sufficiently rotating sear 100, lower surface 114 of actuating portion 110 thereof is caused to sear with hammer 940, as can be seen in the dashed ellipse in FIG. 10B. In turn, hammer 940 is released, causing rifle 900 to initiate a subsequent firing cycle without need to release the trigger to do so. Thereafter, the cycle of rearward and forward motion of the bolt carrier 920 and consequent automatic tripping of sear 100 can be repeated, as desired, thereby providing rifle 900 with full-automatic and/or burst firing capabilities, in accordance with several embodiments.

In accordance with an embodiment, permitting sear lever 200 to extend beyond upper surface 113 of sear 100 can aid in preventing sear 100 from coming into direct physical contact with bolt carrier 920 of rifle 900, and thus help to eliminate or otherwise reduce the likelihood of binding rifle 900 during full-automatic, burst, and/or semi-automatic firing thereof. Also, as previously discussed, sear spring 400 can be preloaded against sear 100 and thus toggling of the safe/fire selector switch 930 (e.g., by rotation thereof) serves to set the pressure angle of sear 100, bringing sear 100 into and out of index with hammer 940, as desired. Therefore, and in accordance with an embodiment, sear lever 200 can be permitted to be deflected rearward and forward during any given firing sequence, but need not necessarily be utilized to impart rotation to sear 100 during that firing sequence. By virtue of how sear lever 200 and sear 100 are operatively interfaced, sear lever 200 can be both permitted and prevented from operating to trip sear 100, as desired. Thus, and in accordance with an embodiment, sear assembly 10 can be operatively coupled, for example, with a safe/fire selector switch 930 without interfering with the semi-automatic firing and/or safe modes of rifle 900. In other words, sear lever 200 can be used, in accordance with an embodiment, to: (1) trip sear 100 selectively, such as when safe/fire selector switch 930 is toggled only to a full-automatic firing mode or a burst firing mode (if applicable); and (2) to otherwise be inoperative (though still incident with bolt carrier 920) in other modes, such as a semi-automatic firing mode and/or safe mode.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. An automatic sear assembly for a rifle, the assembly comprising:

an automatic sear configured to be operatively coupled with a safe/fire selector switch and a hammer of the rifle;

a sear lever disposed adjacent a rear surface of the automatic sear and extending beyond a height of the automatic sear;

a first spring disposed adjacent the sear lever and the rear surface of the automatic sear and configured to bias the sear lever into physical contact with the rear surface of the automatic sear; and a second spring disposed adjacent the sear lever and the rear surface of the automatic sear and configured to operatively interface with the safe/fire selector switch;

wherein the automatic sear, the sear lever, the first spring, and the second spring share a rotational axis; and wherein rotational deflection of the sear lever in a first direction about the shared rotational axis causes the sear lever to rotate out of physical contact with the rear surface of the automatic sear, and rotational deflection of the sear lever in a second direction about the shared rotational axis imparts rotation to the automatic sear causing the automatic sear to sear with the hammer of the rifle.

2. The assembly of claim 1, wherein the sear lever is configured to be incident with a bolt carrier of the rifle, the bolt carrier providing rotational deflection of the sear lever in at least one of the first direction and/or the second direction about the shared rotational axis.

3. The assembly of claim 1, wherein the sear lever extends beyond the height of the automatic sear by a distance in the range of ⅛ to ½ inch.

4. The assembly of claim 1, wherein the first spring comprises a helical torsion spring including a set of coils ending in first and second tangential legs.

5. The assembly of claim 1, wherein:

toggling of the safe/fire selector switch into a full-automatic firing mode or a burst-firing mode causes the automatic sear to rotate about the shared rotational axis into index with the hammer of the rifle; and toggling of the safe/fire selector switch into a semi-automatic firing mode or a safe mode causes the automatic sear to rotate about the shared rotational axis out of index with the hammer of the rifle.

6. The assembly of claim 1 further comprising a bushing inserted along the shared rotational axis.

7. The assembly of claim 6 further comprising a pin inserted within the bushing along the shared rotational axis.

8. The assembly of claim 1, wherein the second spring comprises a helical double-torsion spring including first and second sets of coils wound in opposing directions and having an unwound portion disposed there between, the first set of coils ending in a tangential leg configured to operatively interface with the safe/fire selector switch of the rifle, and the second set of coils ending in a radial over-center leg.

9. The assembly of claim 8 further comprising:

a bushing inserted along the shared rotational axis, the bushing having a slot formed therein; and a pin inserted within the bushing along the shared rotational axis, the pin having a groove formed therein;

wherein the groove and the slot are configured to align when the pin is inserted within the bushing and configured to receive the radial over-center leg of the second spring.

10. The assembly of claim 1, wherein at least a portion thereof is compliant with United States Defense Standard MIL-W-13855 (Weapons: Small Arms and Aircraft Armament Subsystems, General Specification For).

11. A rifle comprising the automatic sear assembly of claim 1.

12. The rifle of claim 11, wherein the rifle is chambered for rounds larger than or equal to .223 caliber rounds (5.56×45 mm NATO rounds).

13. The rifle of claim 11, wherein the rifle is chambered for .308 caliber rounds (7.62×51 mm NATO rounds).

14. The rifle of claim 11, wherein the rifle is chambered for .30-06 caliber rounds (7.62×63 mm rounds).

15. The rifle of claim 11, wherein the rifle is constructed and arranged to implement at least one of a full-automatic firing mode, a burst-firing mode, a semi-automatic firing mode, and/or a safe mode.

16. An automatic sear assembly for a rifle, the assembly comprising:

an automatic sear rotationally mounted about an axis, the automatic sear having an actuating portion which extends a first radial length from the axis in a first direction and a second radial length from the axis in a second direction which substantially opposes the first direction, wherein the automatic sear interfaces with a safe/fire selector switch and a hammer of the rifle;

a sear lever rotationally mounted about the axis independently of the automatic sear, the sear lever extending a third radial length from the axis in substantially the same first direction, wherein the third radial length is greater than the first radial length;

a first spring mounted about the axis and biasing the sear lever into physical contact with the automatic sear; and a second spring mounted about the axis and angularly biasing the automatic sear about the axis, wherein the second spring interfaces with the safe/fire selector switch.

17. The assembly of claim 16, wherein the third radial length is greater than the first radial length by a distance in the range of ⅛ to ½ inch.

18. The assembly of claim 16, wherein:

toggling of the safe/fire selector switch into a full-automatic firing mode or a burst-firing mode causes the automatic sear to rotate about the shared rotational axis into index with the hammer of the rifle; and toggling of the safe/fire selector switch into a semi-automatic firing mode or a safe mode causes the automatic sear to rotate about the shared rotational axis out of index with the hammer of the rifle.

19. An automatic sear assembly for a rifle, the assembly comprising:

an automatic sear configured to be operatively coupled with a safe/fire selector switch and a hammer of the rifle;

a sear lever disposed adjacent a rear surface of the automatic sear and extending beyond a height of the automatic sear;

a helical torsion spring disposed adjacent the sear lever and the rear surface of the automatic sear and comprising a set of coils ending in first and second tangential legs configured to bias the sear lever into physical contact with the rear surface of the automatic sear; and a helical double-torsion spring disposed adjacent the sear lever and the rear surface of the automatic sear and comprising first and second sets of coils wound in opposing directions and having an unwound portion disposed there between, the first set of coils ending in a tangential leg configured to operatively interface with the safe/fire selector switch of the rifle, and the second set of coils ending in a radial over-center leg;

wherein the automatic sear, the sear lever, the helical torsion spring, and the helical double-torsion spring share a rotational axis;

wherein the assembly further comprises:

a bushing inserted along the axis, the bushing having a slot formed therein; and a pin inserted within the bushing along the axis, the pin having a groove formed therein;

wherein the groove and the slot are configured to align when the pin is inserted within the bushing and configured to receive the radial over-center leg of the helical double-torsion spring; and wherein rotational deflection of the sear lever in a first direction about the axis causes the sear lever to rotate away from the rear surface of the automatic sear, and rotational deflection of the sear lever in a second direction about the axis imparts rotation to the automatic sear causing the automatic sear to sear with the hammer of the rifle.

20. A rifle comprising the automatic sear assembly of claim 19, wherein the rifle is chambered for rounds larger than or equal to .223 caliber rounds (5.56×45 mm NATO rounds).

* * * * *